US005448860A

United States Patent [19]

Menke et al.

[11] Patent Number: 5,448,860

[45] Date of Patent: Sep. 12, 1995

[54] PREFABRICATED OBSERVATORY DOME STRUCTURE

[76] Inventors: John L. Menke; Mary E. Menke, both of 22500 Old Hundred Rd., Barnesville, Md. 20838

[21] Appl. No.: 47,448

[22] Filed: Apr. 16, 1993

[51] Int. Cl.[6] ..... F04B 1/32

[52] U.S. Cl. ..... 52/80.1; 52/66; 52/86; 52/245; 52/579; 52/588.1; 49/40; 49/41; 49/125

[58] Field of Search ..... 52/66, 86, 245, 80.1, 52/579, 588.1; 49/40, 41, 125

[56] References Cited

U.S. PATENT DOCUMENTS

| | | | |
|---|---|---|---|
| 1,258,805 | 3/1918 | Parmley | 52/245 |
| 2,384,646 | 9/1945 | Schwab . | |
| 2,846,962 | 8/1958 | Morgan . | |
| 2,996,844 | 8/1961 | Paulson . | |
| 3,180,057 | 4/1965 | Pritzker . | |
| 3,213,571 | 10/1965 | Olson | 52/66 |
| 3,266,203 | 8/1966 | Krantz . | |
| 3,340,658 | 9/1967 | Dueringer . | |
| 3,359,682 | 12/1967 | Clark . | |
| 3,370,380 | 2/1968 | Petros . | |
| 3,381,422 | 5/1966 | Olson . | |
| 3,481,094 | 12/1969 | Taylor | 52/588.1 |
| 3,513,608 | 5/1972 | Nagrod . | |
| 3,675,380 | 7/1972 | Moss . | |
| 3,744,205 | 7/1973 | Moss . | |
| 3,827,182 | 8/1974 | Van Helleputte . | |
| 3,827,200 | 8/1974 | Preissler . | |
| 3,893,269 | 7/1975 | Nelsson et al. . | |
| 3,946,567 | 3/1976 | Oger | 52/245 |
| 3,951,294 | 4/1976 | Wilson . | |
| 3,996,752 | 12/1976 | Oger . | |
| 4,063,393 | 12/1977 | Toti . | |
| 4,068,421 | 1/1978 | Marovich . | |
| 4,099,352 | 7/1978 | Clark . | |
| 4,112,644 | 9/1978 | Allen . | |
| 4,159,603 | 7/1979 | Schroeder . | |
| 4,202,147 | 5/1980 | Krogh . | |
| 4,364,211 | 12/1982 | Arp et al. . | |
| 4,557,090 | 12/1985 | Keller, Sr. . | |
| 4,730,427 | 3/1988 | Tomsin . | |
| 4,788,803 | 12/1988 | Seitz . | |
| 4,907,383 | 3/1990 | Winter, IV . | |
| 4,965,970 | 10/1990 | Nania . | |
| 5,096,253 | 3/1992 | Jo et al. . | |

FOREIGN PATENT DOCUMENTS

| | | | |
|---|---|---|---|
| 0492043 | 3/1992 | Japan | 52/80.1 |
| 73965 | 1/1954 | Netherlands | 52/245 |
| 0935579 | 6/1982 | U.S.S.R. | 52/80.1 |
| 0937657 | 6/1982 | U.S.S.R. | 52/80.1 |
| 0969857 | 10/1982 | U.S.S.R. | 52/80.1 |

*Primary Examiner*—Carl D. Friedman
*Assistant Examiner*—Christopher Todd Kent
*Attorney, Agent, or Firm*—Orzechowski & Nalls

[57] ABSTRACT

A prefabricated observatory dome structure comprising a base portion constructed from connectable arcuate panels, a rotatable dome constructed from connectable panels and a vertically slidable shutter. The flange design of the base portion provides a water-tight non-caulked wall. A semi-door permits easy access to the observatory structure. The shutter has three sections that slide together using a latching system to slide back to expose more that half of the opening to permit observation at the zenith of the unit.

25 Claims, 16 Drawing Sheets

PREFABRICATED OBSERVATORY DOME STRUCTURE

FIELD OF INVENTION

This invention generally relates to a prefabricated observatory dome structure having a base, a dome and a retractable shutter system. In particular, the present invention is directed to a rotatable observatory dome structure with a retractable shutter system that allows 360 degree viewing from the horizontal to past the zenith. The invention is also directed to a modular wall system formed from connectable wall panels used to construct the base portion of the observatory dome.

BACKGROUND OF INVENTION

Observatory dome structures have been known and used for many years. They provide shelter from the elements and protection from the wind for both the astronomer and the delicate telescopic equipment. However, the prior art designs have required the construction of very expensive large permanent structures with extremely complex mechanisms for the movement of the shutter and the rotation of the dome. This has placed an observatory dome structure out of the reach, and the pocketbook, of an amateur astronomer.

Some attempts have been made to construct small domes for the use of the backyard astronomer. However, these domes have required the construction of permanent buildings for the dome structure to be placed upon. These buildings have tended to be large solid masonry structures so that the weight of the dome could be supported, particularly during rotation.

Observatory dome structures have been made from a variety of materials. Metal or wooden domes have required the use of many parts and a strong frame for supporting the skin of the dome. With fiberglass domes, there has been a difficulty with the transportation of the domes, due to large diameter pieces with curvilinear shapes, and the need to use chemical welding to join the parts.

The equipment needed to permit the dome to rotate freely in a 360 degree path has been bulky and complex. Such a rotatable dome system is shown in U.S. Pat. No. 2,846,962.

Observatory dome structures contain an opening through which the telescope is pointed. The opening preferably is of a size and shape, generally rectangular, so as to permit the telescope to be rotated from the horizontal position to the vertical position. The opening is closed with a shutter or shutters when the telescope is not in use. The shutters conform to the opening and are usually rectangular in shape. This creates a major problem in dome shutter design in that the opening is rectangular, is significantly greater in length than in width, and is longer than half the surface available on the dome. Thus, a single piece shutter cannot be stored on or adjacent to the dome structure surface without hanging over the edge creating interference with the rest of the structure and exposing the shutter edge to the detrimental effects of the wind.

One prior art solution to this problem has been to move the shutter sideways or horizontally, either as a single piece or as split halves as shown in U.S. Pat. Nos. 3,370,380; 3,359,682 and 2,996,844. This type of horizontal movement of the shutter requires that the shutter or shutters be mounted on a rail system with the use of complex mechanical systems to effect movement of the top and bottom of the shutter at the same time. Additionally, the shutter is exposed to the wind, requiring a very strong structure to be able to physically hold it in place. The long joint that the shutter makes with the dome, and for a split shutter, with itself, is prone to leakage.

The use of the prior art vertical operating shutters have also had a host of problems. A one piece vertical shutter, such as that depicted in U.S. Pat. No. 3,213,571, must be able to pivot away from the observatory dome structure, greatly increasing the complexity of the equipment and the wind resistance of the structure. The use of a two piece shutter system that moves vertically has similar problems with the storage of the shutter in the open position and wind resistance. Additionally, each half must move more than its own length. Moving both pieces at the same time doubles the complexity of the mechanism used, particularly if separate motor systems are to be coordinated. Furthermore, since the bottom, or front shutter must move through the space occupied by the top shutter, restrictions are placed on the drive and guideway system.

It has now been discovered that a prefabricated observatory dome structure can be constructed from a modular wall system, a dome of connected panels, and a three part shutter with an opening and latching system, so that the backyard astronomer can have an effective wind and weather resistant observatory.

SUMMARY OF THE INVENTION

The present invention is directed to an easily manufactured and readily assembled prefabricated observatory dome structure comprising a base portion, a rotatable dome portion and a vertically slidable shutter system.

The base portion is in the form of a readily assembled modular wall system made from at least one ring. Each ring is formed from arcuate ring sections assembled to form a circular ring. In one embodiment of the invention, an internal return or reverse flange design is used to connect the rings of the modular wall system in a water-tight non-caulked seal.

The rotatable dome portion is rotatably mounted upon the base and is constructed from prefabricated, connectable panels in the form of two hemispherical halves connected by the vertically slidable shutter system. The dome hemispherical halves are connected to the horizontal flange of a dome support ring. The dome support ring has a vertical skirt that covers the opening between the dome and the wall, keeping the structure weather tight and maintaining the dome in position on the base portion. The dome may also be retained in place by use of a reverse flange on the base ring or by use of a wind clip. The rotatable mounting of the dome portion to the wall portion is achieved by means of rollers mounted in the top flange of the base ring portion of the wall. The dome portion may be rotated by hand or by use of a motorized system.

The shutter system comprises three sections—a front shutter, a top shutter and a rear cover—that allow the shutter to slide back more than halfway to permit observation at the zenith of the unit. The shutter sections are in the form of a water-tight nesting arrangement where the top shutter is larger than the front shutter, which in turn is larger than the rear cover. Through the use of a unique latching system, the front and top shutters slide together as a unit up and back over the rear cover. As the front and top shutters reach the rear storage position, the front and the top shutters disconnect. The front shutter continues to the rear storage location so that the front and top shutters sections are in a nested arrangement with the rear cover.

The unique latching system is a passive mechanical system that allows the shutter sections to lock and unlock automatically during both the opening and the closing operations. In one embodiment, latches located at the front and rear edges of the top shutter drop into a receiving holes on the front shutter and the rear cover.

A semi-door in the base portion of the observatory dome structure permits easy access to the interior of the observatory structure. The shutter opening in the dome portion serves as the top half of the doorway while a semi-door formed by a hinged section of the dome support ring and a hinged section of the wall ring or rings acts as the bottom half of the doorway. The semi-door may be a cut-out section or may be separately molded.

BRIEF DESCRIPTION OF THE DRAWINGS

Other features and advantages of this invention will become apparent in the following detailed description of a preferred embodiment of this invention, with reference to the accompanying drawings in which.

DETAILED DESCRIPTION OF THE INVENTION

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
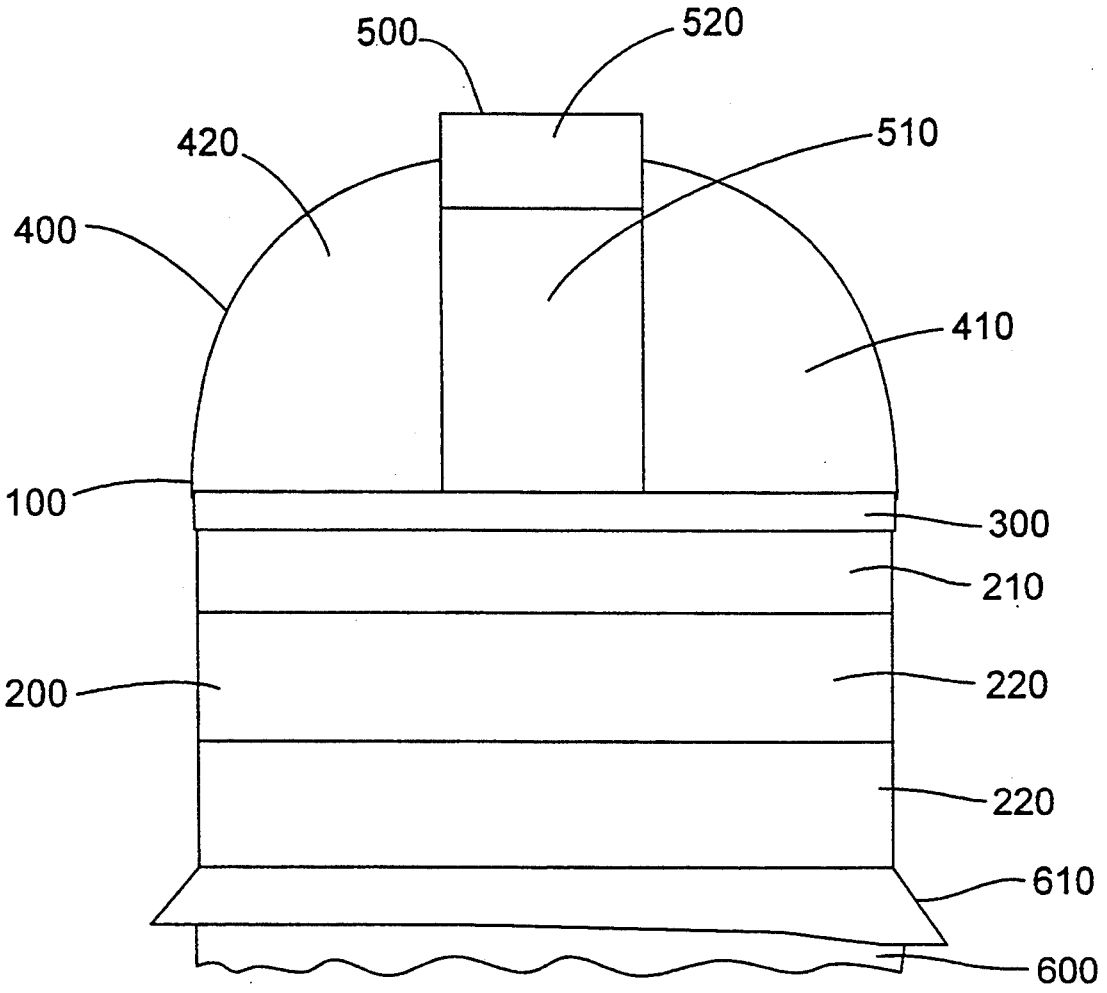
FIG. 1 is a schematic front perspective view of one embodiment of the prefabricated observatory dome structure of the present invention with the shutter in a closed position.
Figure 2:
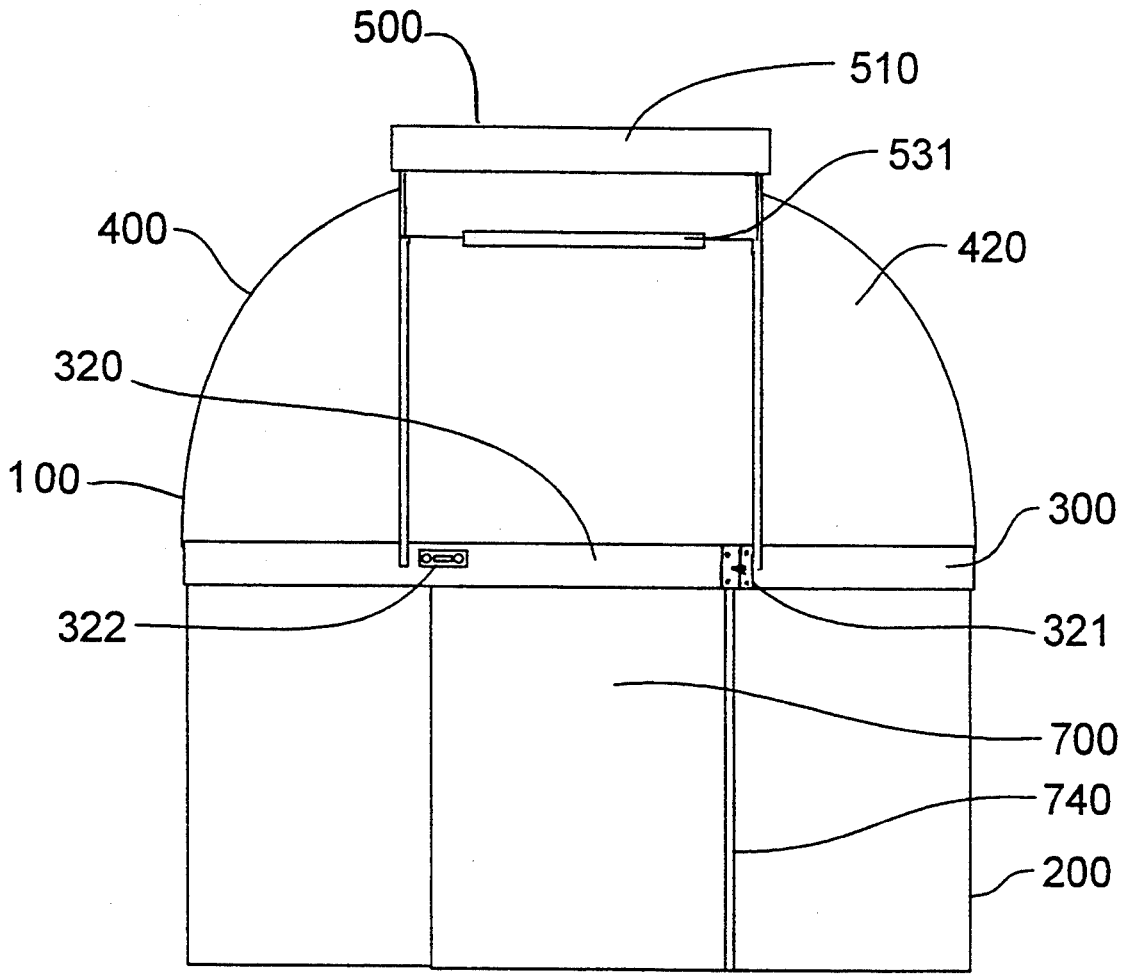
FIG. 2 is a schematic front perspective view of an alternative embodiment of the prefabricated observatory dome structure with a built-in semi-door and with the front shutter in a partially retracted position.

Referring now to the drawings, the invention will be described in greater detail. A preferred embodiment of the prefabricated observatory dome structure 100 is shown in FIG. 1 and an alternative embodiment with a semi-door is shown in FIG. 2. The observatory dome structure 100 is easy to manufacture and readily transported to the desired site for assembly. The observatory dome structure 100 comprises a base portion 200, a rotatable dome 400 mounted on the base portion 200 and a shutter system 500. Advantageously the observatory dome structure is constructed from modular parts that are readily assembled. The use of modular parts allows light weight construction and easy transportation.

As will readily be appreciated by those skilled in the art, the component parts of the unique observatory dome structure of the present invention may be prefabricated at the factory and due to the light weight and compactness of the component parts can be simply and relatively inexpensively shipped to the chosen building site. Also, the sections or panels which comprise the component parts are easily handled and are adapted to be speedily assembled by unskilled or semi-skilled labor without the use of special tools or equipment. If desired the observatory dome structure may be erected in such a manner that it can be readily disassembled.

The base portion 200 of observatory dome structure 100 is preferably in the form of a modular wall system comprising at least a base ring 210, and, optionally, one or more wall rings 220. The number of wall rings 220 to be used will depend upon the desired height of the base portion 200. This construction allows flexibility in the size of the observatory dome structure 100 and tailoring of the structure to the needs of the user and to the specific site selected.

Figure 3:
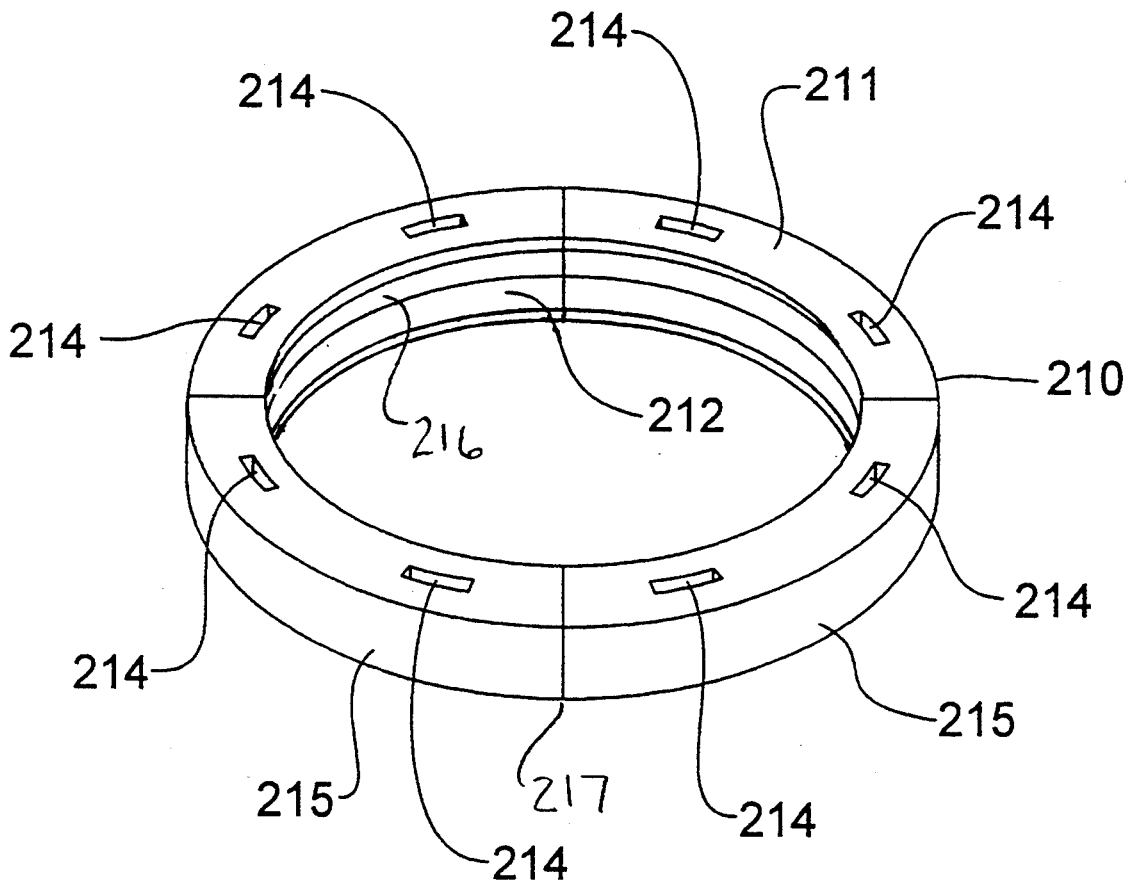
FIG. 3 is a schematic top perspective view of the base ring depicted in FIG. 1.
Figure 8:
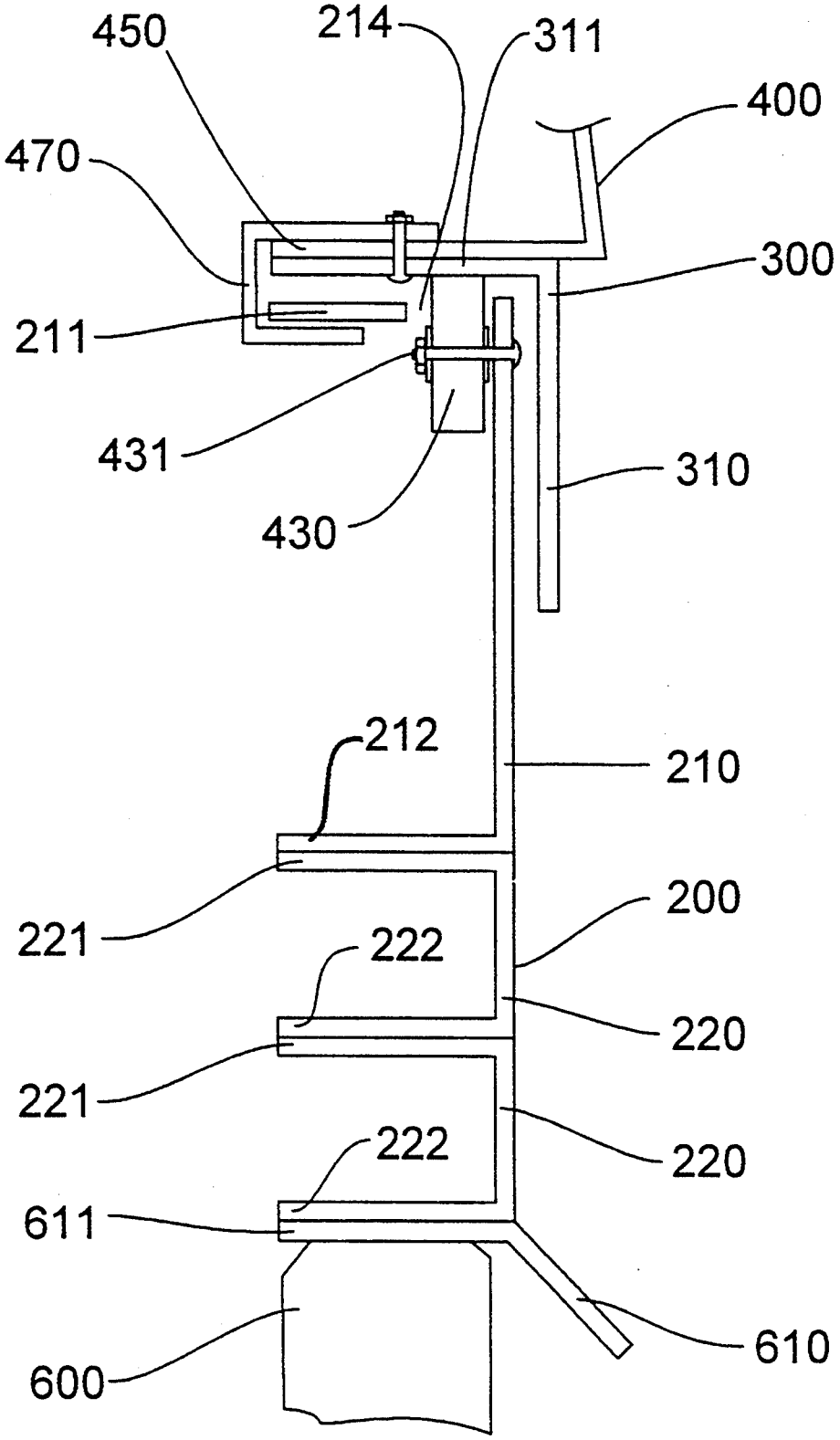
FIG. 8 is a partial schematic side sectional view of a portion of the observatory dome of FIG. 1 showing in detail the construction of the base portion.
Figure 9:
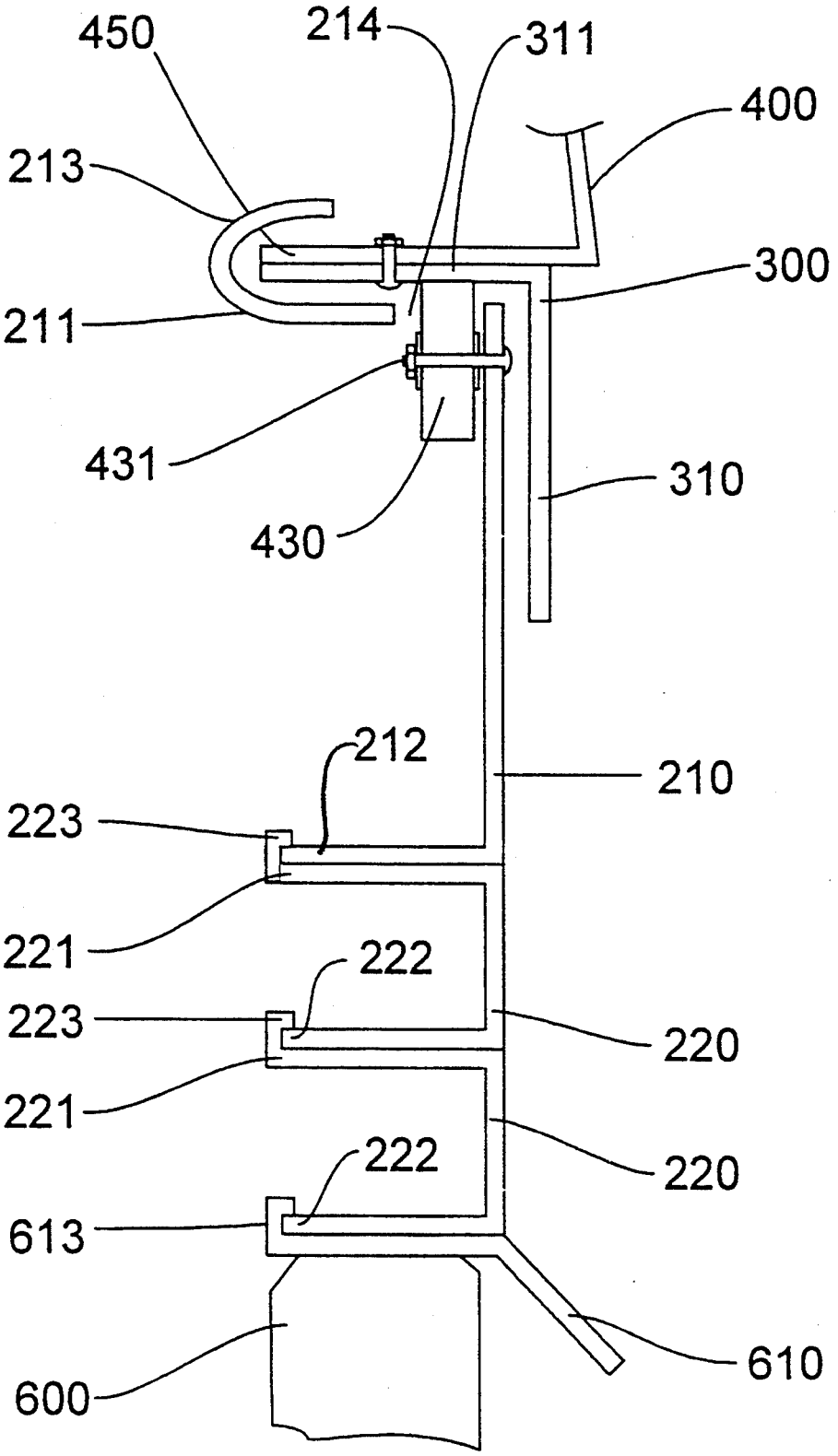
FIG. 9 is a partial schematic side sectional view of a portion of an alternative embodiment of the present invention depicting the reverse flange system.

The base ring 210, shown in detail in FIG. 3, has a generally C-shaped cross-section, as shown in FIGS. 8 and 9, and is constructed from multiple base ring sections 215. Each base ring section 215 is in the form of an arc and has a side wall 216 with an inwardly facing upper flange 211 and lower flange 212. Base ring roller openings 214 are located in the base ring upper flange 211. The base ring sections are fastened together by any suitable means. In one embodiment, end flanges 217 are located at each end of the base ring section arc 215 and are used to fasten the ends of the arc together to form the circular base ring 210. The number of ring sections 215 used may vary and will depend upon a number of factors including the finished size of the base ring 210, the degree of curvature and the length of each base ring section 215. In an alternative embodiment, the base ring 210 may comprise a single piece. However, for ease of transport of large structures, it is generally preferable to construct the base ring 210 from a plurality of base ring sections 215.

Figure 4:
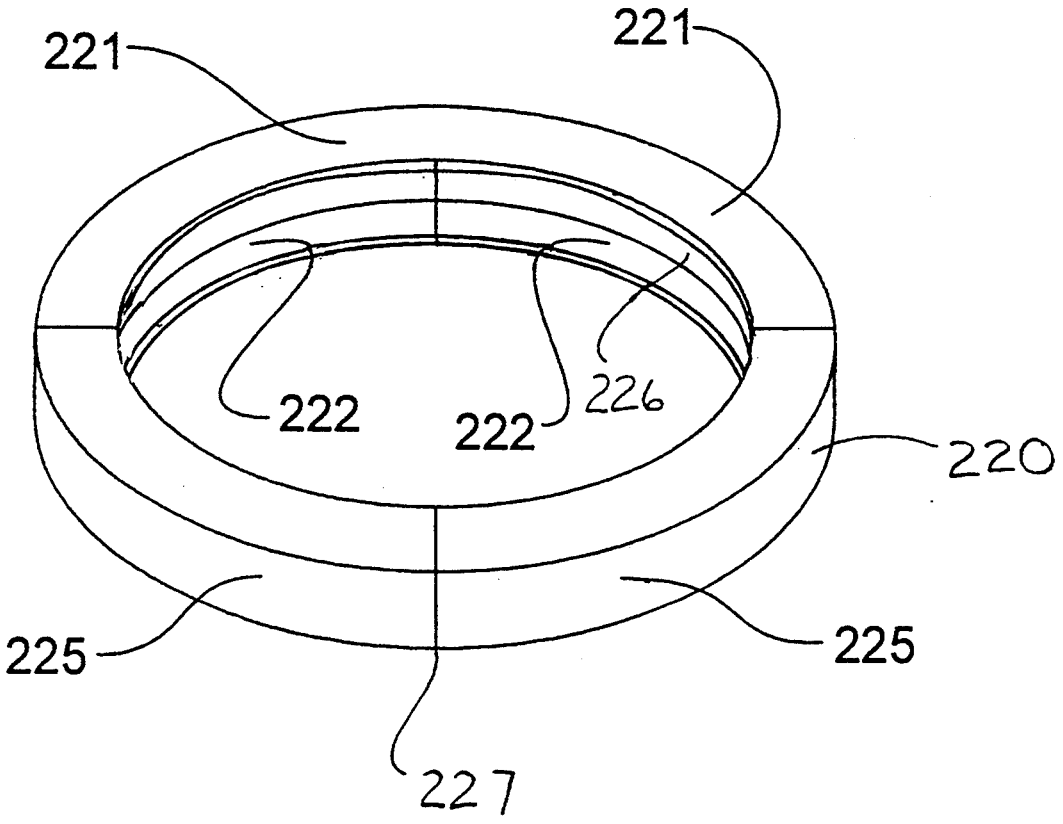
FIG. 4 is a schematic top perspective view of a wall ring depicted in FIG. 1.

The wall rings 220, depicted in FIG. 4, are of the same general design as the base ring 210, with the base ring 210 differing in the roller openings 214 in the base ring upper flange 211. Each wall ring 220 is constructed from wall ring sections 225 in the same manner as the base ring 210 and has a side wall 226 with an inwardly facing upper flange 221 and lower flange 222. The wall ring sections are fastened together by any suitable means. In one embodiment, end flanges 227 are located at each end of the wall ring section arc and are used to fasten the ends of the arc together to form the circular wall ring 220. The end flanges may have any suitable construction, such as that detailed in FIGS. 6 and 7. The wall rings 220 are connected to each other by fastening the upper flange 221 of one wall ring 220 to the lower flange 222 of another wall ring 220, as shown in FIGS. 8 and 9. The upper flange 221 of the uppermost wall ring 220 is fastened to the base ring lower flange 212 by any suitable means.

Figure 5:
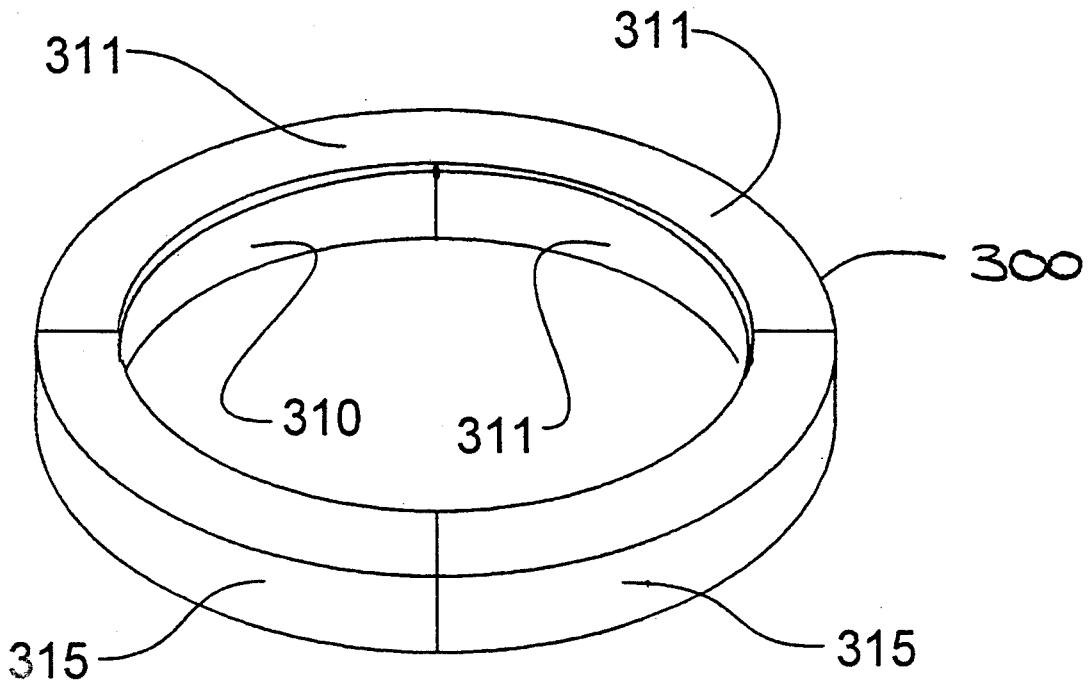
FIG. 5 a schematic top perspective view of the dome support ring depicted in FIGS. 1 and 2.

The dome support ring 300, depicted in FIG. 5, is similar in construction to the base ring 210 and the wall rings 220, but without the lower flange so that the dome support ring 300 has an L-shape cross-sectional area instead of a C-shaped cross sectional area with an upper flange 311 and a vertical skirt 310. The dome support ring sections 315 are fastened together by any suitable means that will allow free rotation of the dome support ring 300 on the wall structure 200.

Figure 6:
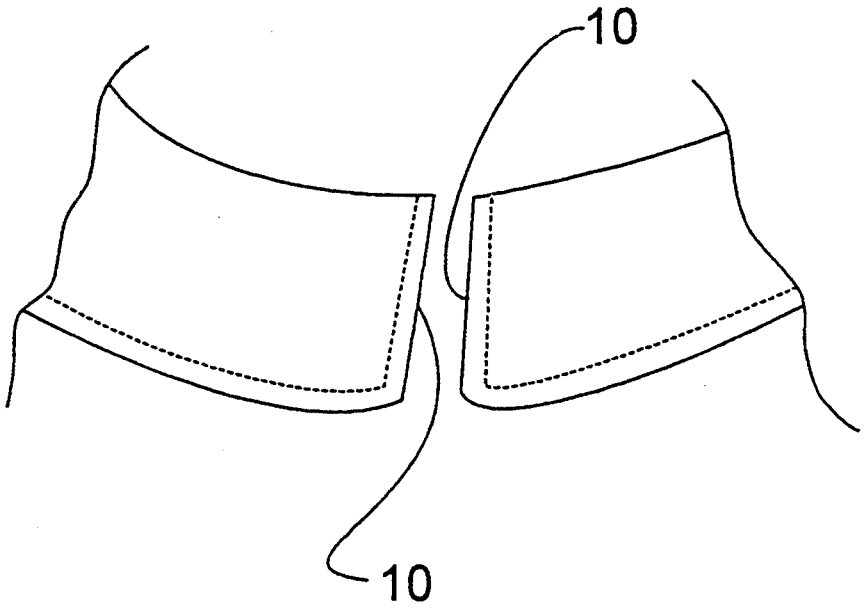
FIG. 6 is a detail view of a connection means for the rings depicted in FIGS. 3 and 4.
Figure 7:
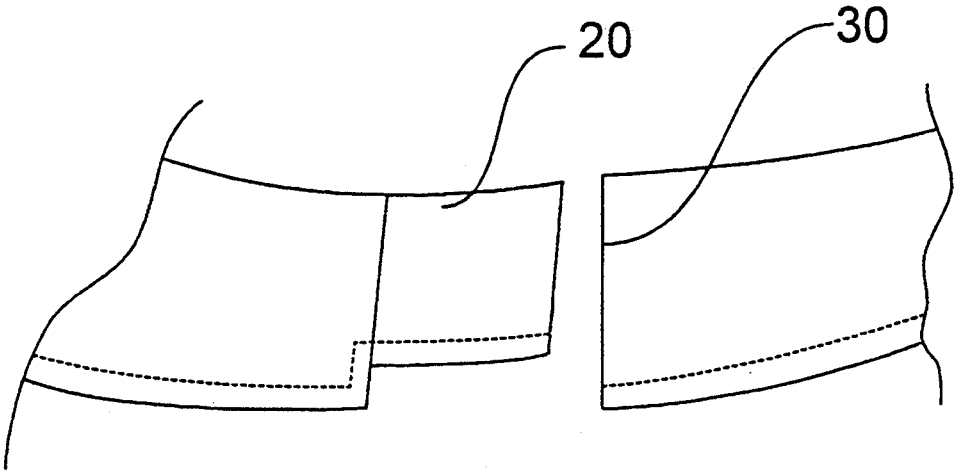
FIG. 7 is a detail view of an alternative connection means for the rings depicted in FIGS. 3 and 4.

As mentioned above, the ring sections making up the base ring 210 and the wall rings 220 may be fastened together by any suitable means. FIGS. 6 and 7 depict two alternative means for connecting the ends of the ring sections together. In FIG. 6, the ring sections have closed ends 10 that are butted together and then fastened by any suitable means, such as bolts or adhesive means. In an alternative embodiment, depicted in FIG. 7, the end flanges of the ring sections have one end 20 that is "stepped" inward (the "male" end) to fit into the "female" end 30 of the other end flange so that the end portions can be overlapped and fastened together.

The base ring 210, the wall rings 220, and the dome support ring 300 are constructed from a lightweight material with sufficient rigidity to support the dome structure and to resist any torsional stresses caused by rotation of the dome such as fiber hardboard, fiber glass, plastic, plywood, sheet metal and the like. In a preferred embodiment, the base ring sections 215, the wall ring sections 225, and the dome support ring sections 315 are molded from resinous material within a cavity mold by generally known molding techniques using generally known resinous compositions that can include fillers and fibrous reinforcement.

Preferably, the base ring sections 215, wall ring sections 225, and the dome support ring sections 315 are constructed from a fiberglass reinforced plastic material. The plastic material may be an epoxy but is most preferably a polyester resin. In its "raw" state, polyester resin is a syrupy liquid that is mixed with an appropriate amount of catalyst to harden the resin. Because the hardened resin is somewhat brittle, it is preferably reinforced with fiberglass for strength, and to prevent the propagation of cracks. The fiberglass can be in the form of woven material which has the resin spread onto and into it, or in the form of long fiberglass strands which are chopped into short pieces, then mixed with resin that is sprayed into a mold. The molded base ring sections 215, wall ring sections 225, and dome support ring sections 315 may be coated with a layer of resin to cover the reinforcing fiberglass to smooth the surfaces and provide additional protection against ultraviolet rays of the sun.

The construction of the wall structure 200 and its attachment to the dome 400 and the dome support ring 300 is shown in more detail in FIGS. 8 and 9.

In one embodiment of the invention shown in FIG. 8, wind clip 470 is used to secure the dome 400 and the dome support ring 300 to the wall structure 200 to prevent the dome 400 and the dome support ring 300 from being blown off the wall structure 200 while still allowing free rotation of the dome 400 and the dome support ring 300.

In one another embodiment of the present invention, depicted in FIG. 9, a novel internal flange design in the form of an internal reverse or return flange is used to impart weather tightness, added strength, and wind resistance. With this novel reverse flange design, a weather tight wall structure can be built without the use of any type of caulking medium. The wall ring reverse flange 223 is located at the end of the wall ring upper flange 221. The base ring reverse flange 213 is similarly at the end of the base ring upper flange 211. FIG. 9 also depicts the use of a foundation skirt 610 with a foundation skirt reverse flange 613 at the end of the foundation skirt flange 611. The reverse flanges 213, 223, 313 and 613 operate to block the incursion of moisture and to return any moisture that may seep in between the connected flanges.

To provide further weather resistance, and comfort to the user in adverse climate conditions, the C-shaped spaces between the upper and lower flanges may be filled with a suitable insulation, such as fiberglass mats, blown-in insulation or the like. The interior wall may also be finished, leaving an air-pocket for insulation.

The modular wall system of the present invention can be made in any desired shape such as straight, curved or a combination and may be used to construct a wall or structure of any desired shape such as a straight line, a curved line, a wavy or serpentine line, a square, a rectangle, a circle, an oval or the like. The modular wall system may be used for construction of other structures such as swimming pool walls, silos, buildings and the like.

A wall of a different construction and shape may be used to support the circular base ring 210 and the observatory dome structure 100 of the present invention. In any case, the wall should have sufficient strength to handle wind loads, resist twisting during rotation of the dome, be water tight and weather resistant, and provide a solid, level support for the lower flange 212 of the observatory base ring 210.

Figure 10:
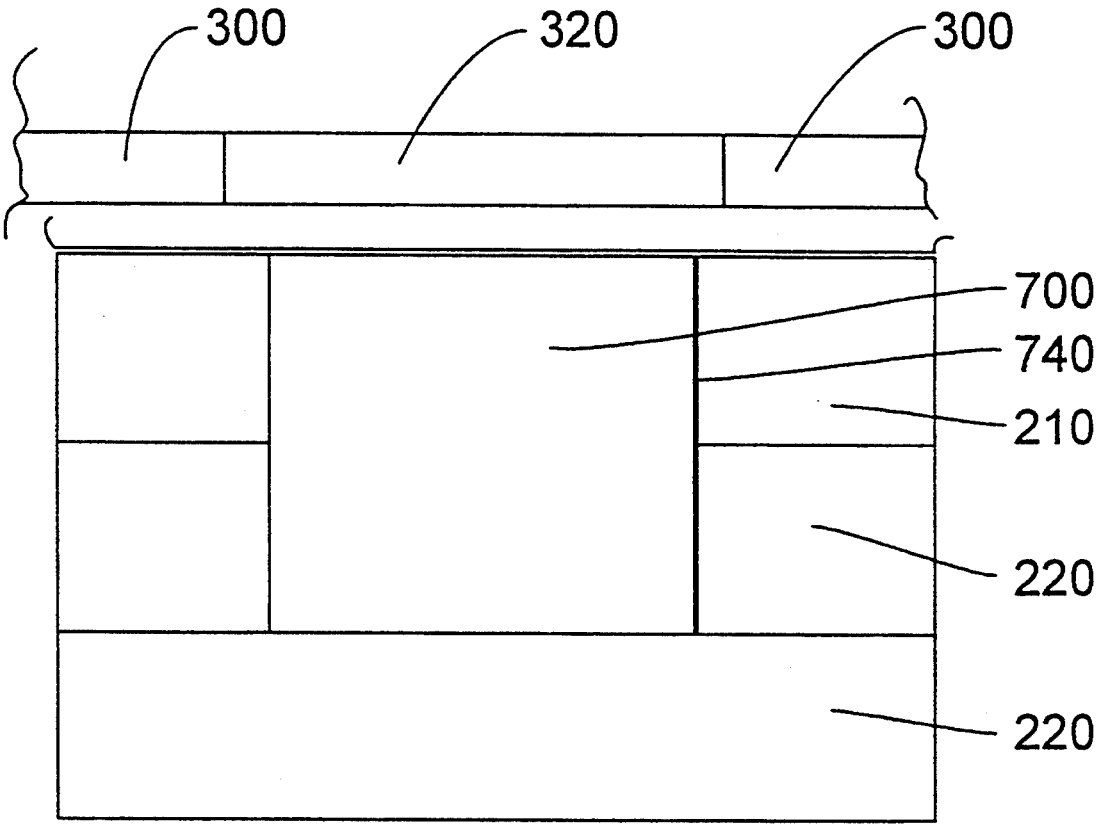
FIG. 10 is a partial schematic front view of the base portion with a semi-door installed.
Figure 11:
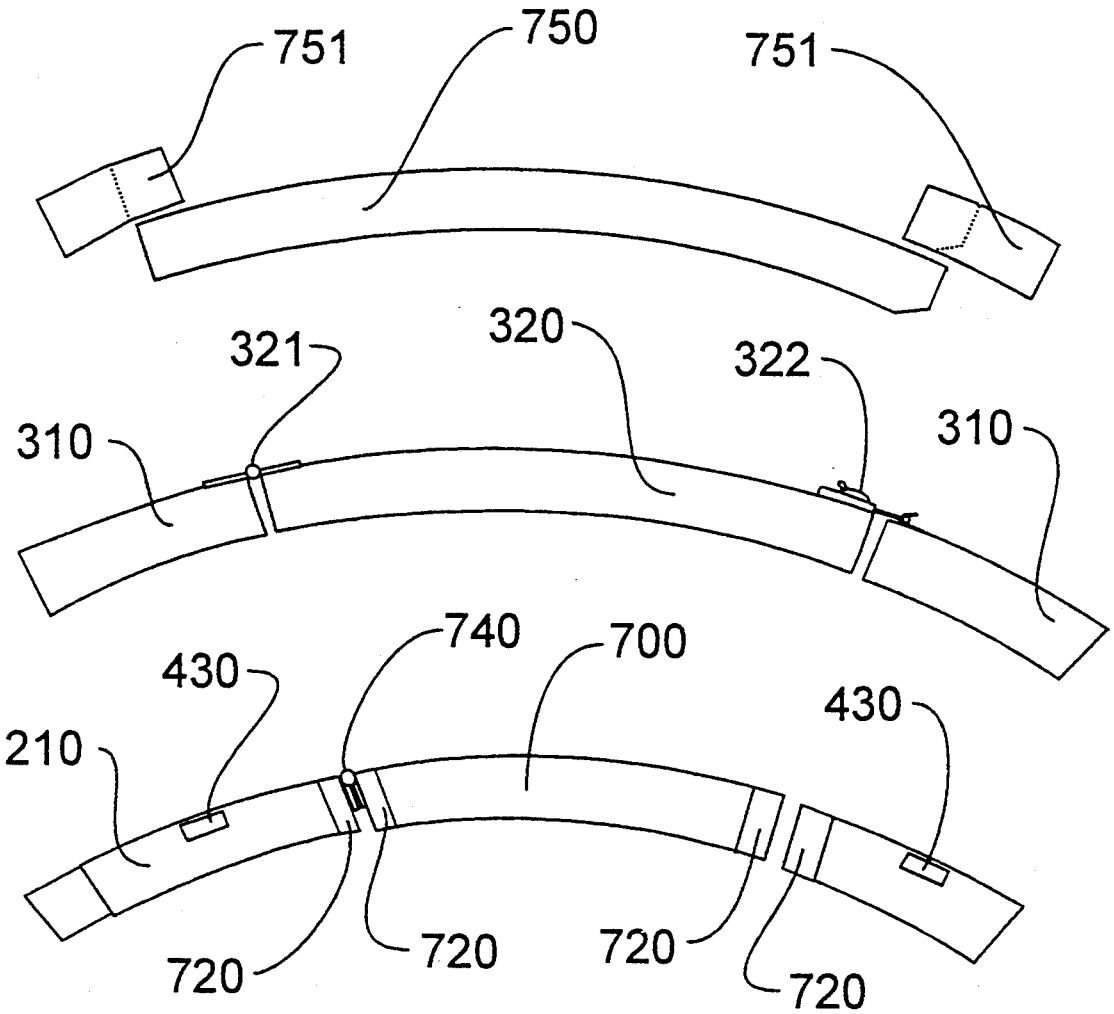
FIG. 11 is a schematic exploded top view of the semi-door of FIG. 10.

In another embodiment of the present invention, depicted in FIGS. 10 and 11, a semi-door 700 is located in the base portion 200 to provide an easier access to the interior of the observatory dome structure 100. The semi-door 700 may extend partially, as shown in FIG. 10, or completely down the length of the base portion 200. If the semi-door 700 will open all the way to the foundation 600, the door portion of the wall also should not contain a connection to the foundation 600. The semi-door 700 also requires that the dome support ring 300 contain a swing-out section 320 in the same location as the semi-door 700. The semi-door 700 is attached to the wall system 200 by a hinge means 740.

In one embodiment, the semi-door 700 is cut into the wall rings 220 and base ring 210, then framed with supports 720 of any variety on the inside of the base portion 200. In an alternate embodiment, the semi-door 700 is molded in a unitary piece with internal flanges located on each side, and on the top and the bottom of the semi-door 700. Where the semi-door 700 is molded in a unitary piece, the matching ends of each wall ring 220 and base ring 210 also are molded with matching inward flanges to allow the semi-door 700 to be hinged to the base portion 200. Appropriate latches of any type may be used to hold the semi-door 700 in place and provide security when the semi-door is not in use.

The swing-out section 320 of the dome support ring 300 is prepared by cutting through the dome support ring flange 311 and dome support ring skirt 310. The cutout section 320 is hinged by hinge means 321 to its mating dome support ring skirt 310 on the same side (left or right) as the semi-door 700 is hinged. On the unhinged side of the cutout section 320, a fastening means 322, such as a draw latch, is used to fasten the cutout section 320 to the dome support ring skirt 310.

The dome support ring flange 311 with its cutout section 320 must be stabilized to provide sufficient rigidity to the dome to allow rotation. This may be achieved by application of a stiffening device. In one embodiment, the stiffening device is a curved, flat latch 750 fastened to the flange portion of swing-out section 320 and a pair of latch receivers 751 fastened to the dome support ring flanges 311 adjacent to each side of the swing-out section 320.

To enter the dome using the semi-door 700, the user first opens the front shutter 510, then opens the dome support ring swing-out section 320, then opens semi-door 700. Once the user has entered, the semi-door 700 must be closed and latched and the dome support ring swing-out section 320 closed and latched before the observatory dome can be rotated.

FIGS. 8 and 9 show the dome rollers 430 that are used to rotate dome 400. The dome rollers 430 are mounted to the inside of the base ring 210 by means of dome roller fasteners 431 so that each dome roller 430 extends partially through the dome roller opening 214 in base ring upper flange 211. The dome 400 is then able to freely rotate 360 degrees on the dome rollers 430.

Figure 12:
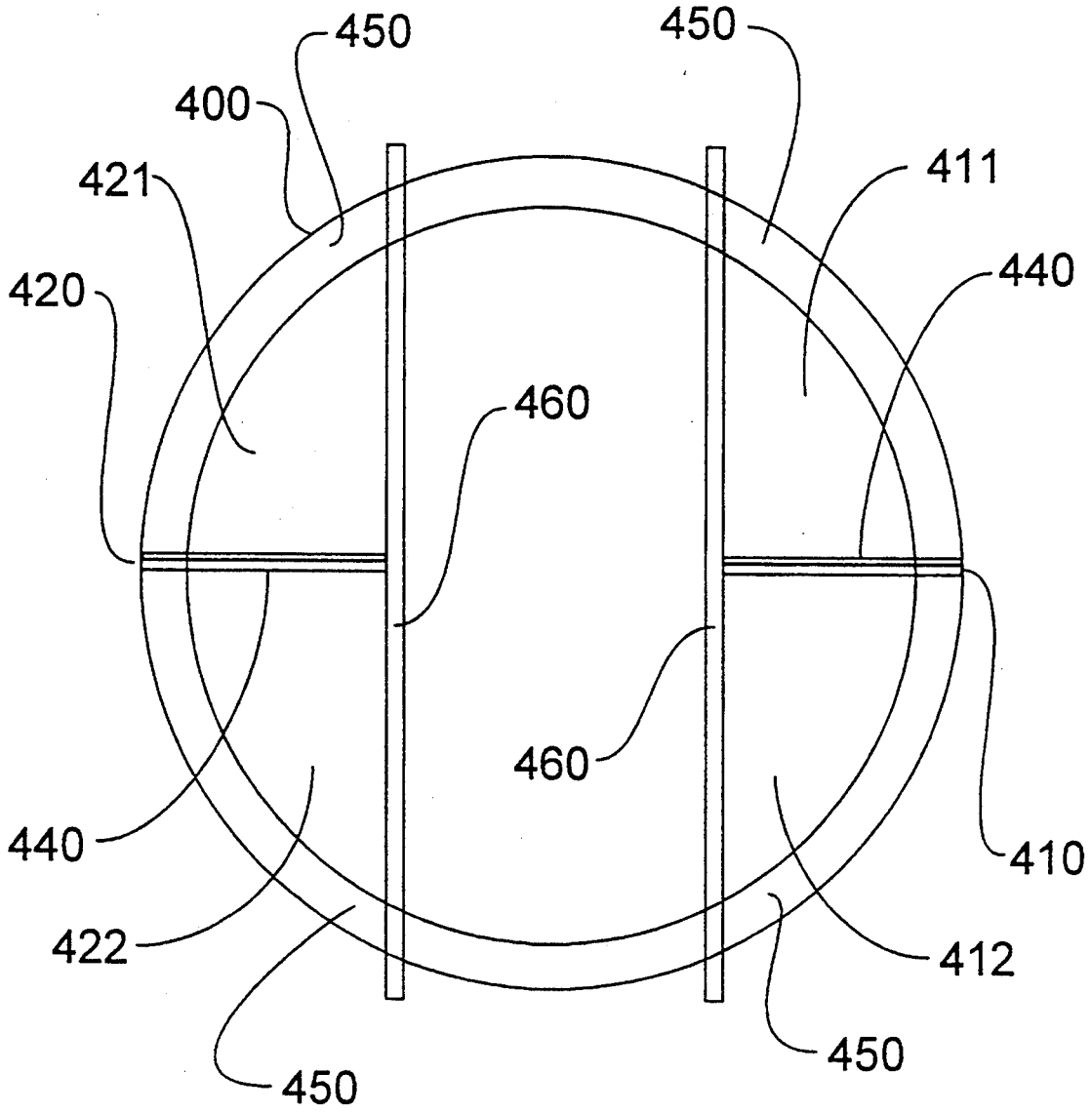
FIG. 12 is a schematic bottom view of the assembled dome.

The bottom of the dome 400 is depicted in FIG. 12. The dome 400 consists of two hemispherical halves, the dome right section 410 and the dome left section 420. In one embodiment the dome hemispheric halves 410 and 420 are made, respectively, of dome quadrants 411 and 412, and of dome quadrants 421 and 422. The greenwich flange 440, an internal flange located on each of the dome quadrants 411, 412, 421 and 422, is used to join the dome sections 411 to 412 and 421 to 422, using any suitable fastening means, to form their respective dome hemispherical halves 410 and 420. Equatorial flange 450 is an internal flange located at the base of each dome section 411, 412, 421, and 422 and serves as the contact point with the dome support ring 300.

In other embodiments, the dome hemispherical halves 410 and 420 may be constructed of one piece each rather than two quadrants, as described above. In this case there will be no greenwich flange 440, but there will still be an equatorial flange 450. In still other embodiments, each of the hemispherical halves 410 and 420 may be constructed of three or more pieces, with each piece containing a greenwich flange 440 and an equatorial flange 450.

Regardless of the number of pieces used to form the hemispherical halves 410 and 420, it must be understood that these "halves" form a complete hemisphere only when the shutters are in place. The opening between the left half 420 and right half 410 is filled in the rear by the rear cover 530, at top by the top shutter 520 and in front by the front shutter 510. When the shutters are open, the base of the circle formed by these "halves" would be incomplete were it not for the dome support ring 300.

The dome support ring 300, as shown in FIG. 5, is formed of dome support ring sections 315 which are joined together make a circle. The dome support ring 300 has an upper flange 311 and a vertical skirt 310. The joints of the circle are not fastened, but rather butt together. The dome support ring flange 311 is fastened to the dome hemisphere equatorial flange 450 by any suitable means. The dome support ring joints must mate under the equatorial flange, not in the opening between hemisphere halves. The underside of the flange 311 rests on the rollers 430 in the base ring flange 211 in a position that allows flange 311 to move freely on the rollers 430. The dome support ring skirt 310 operates to prevent wind, rain and other damaging elements from entering the structure by covering the space between the dome 400 and the base 200.

In operation, the dome may be rotated by hand or by any suitable motorized system. To aid in rotation by hand, appropriate handles or other gripping means may be used. A suitable motorized system is one that would permit the dome to rotate in either a clockwise or a counterclockwise direction.

The operation of one embodiment of the shutter system 500 is shown in FIGS. 13*a* through 13*d*. A schematic depiction of a shutter is shown in FIG. 2 where each shutter piece has a surface section 501 which covers the opening between the dome right quadrant 410 and the dome left quadrant 420. Downward side flanges 502 extend over the shutter opening edge 460 in the dome 400. The rear cover 530 has a horizontal lip 531, as shown in FIGS. 13*a* through 13*d*.

Figure 13A:
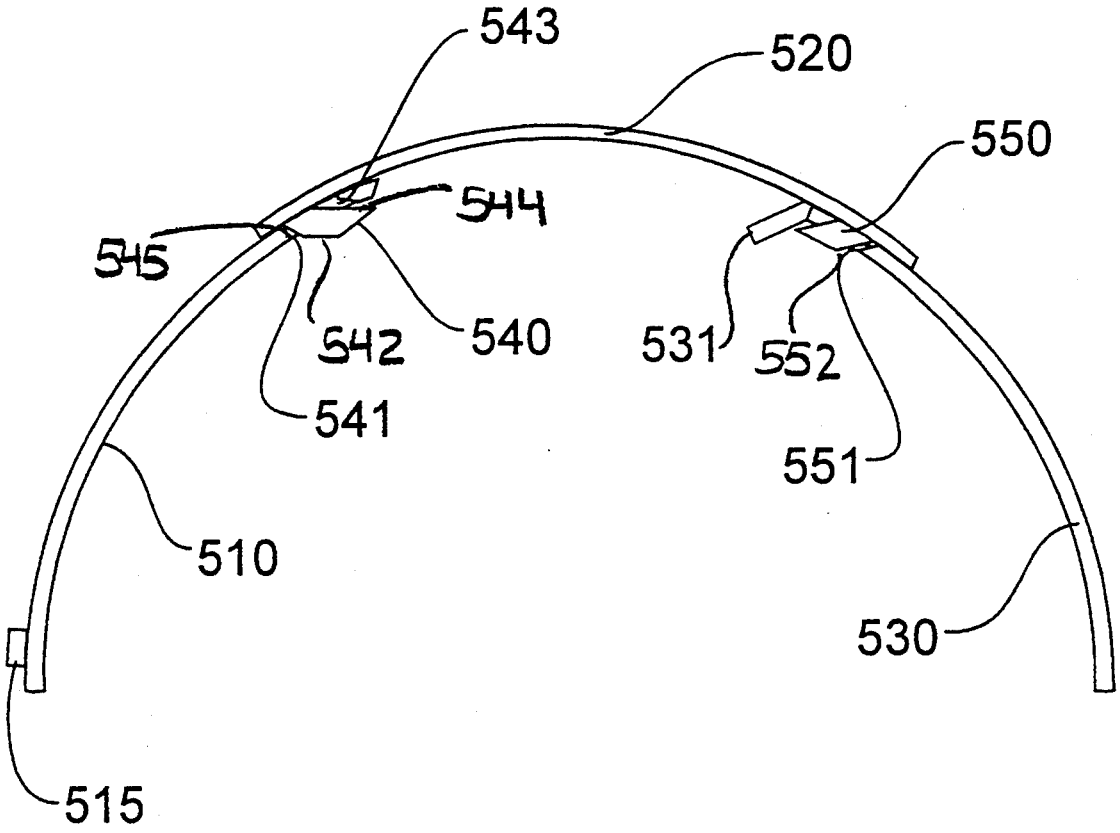
FIGS. 13*a–d* are schematic side sectional views depicting operation of one embodiment of the latching system of the present invention.
Figure 13B:
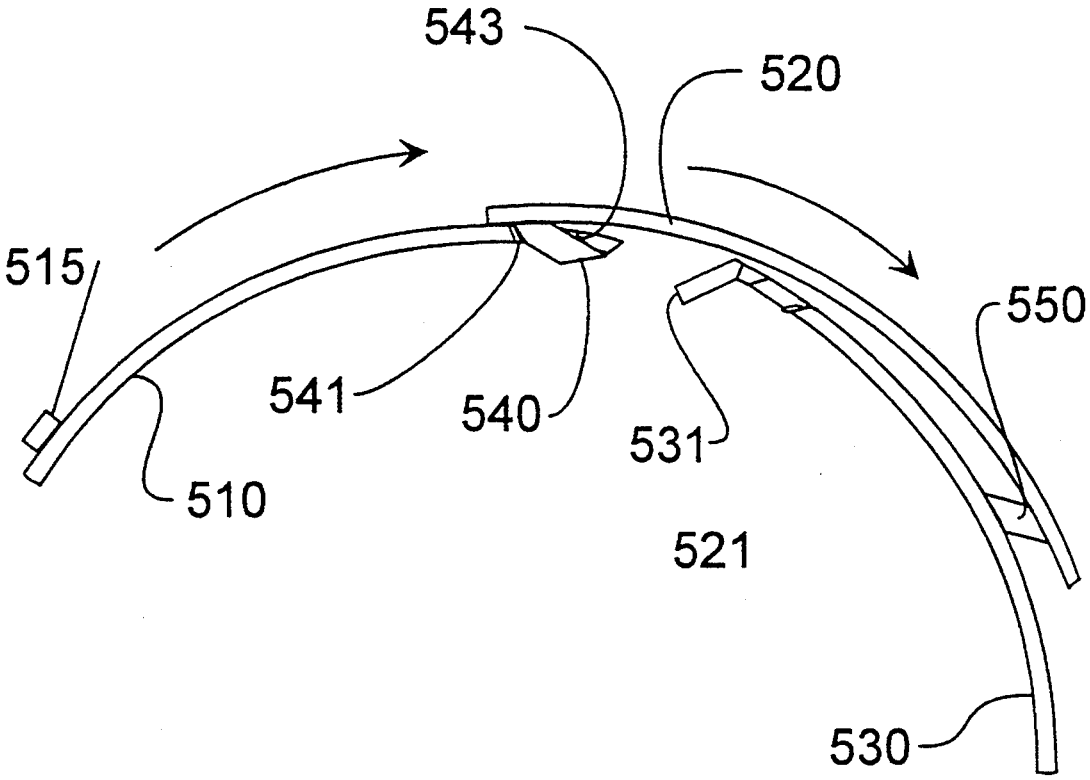
Figure 13C:
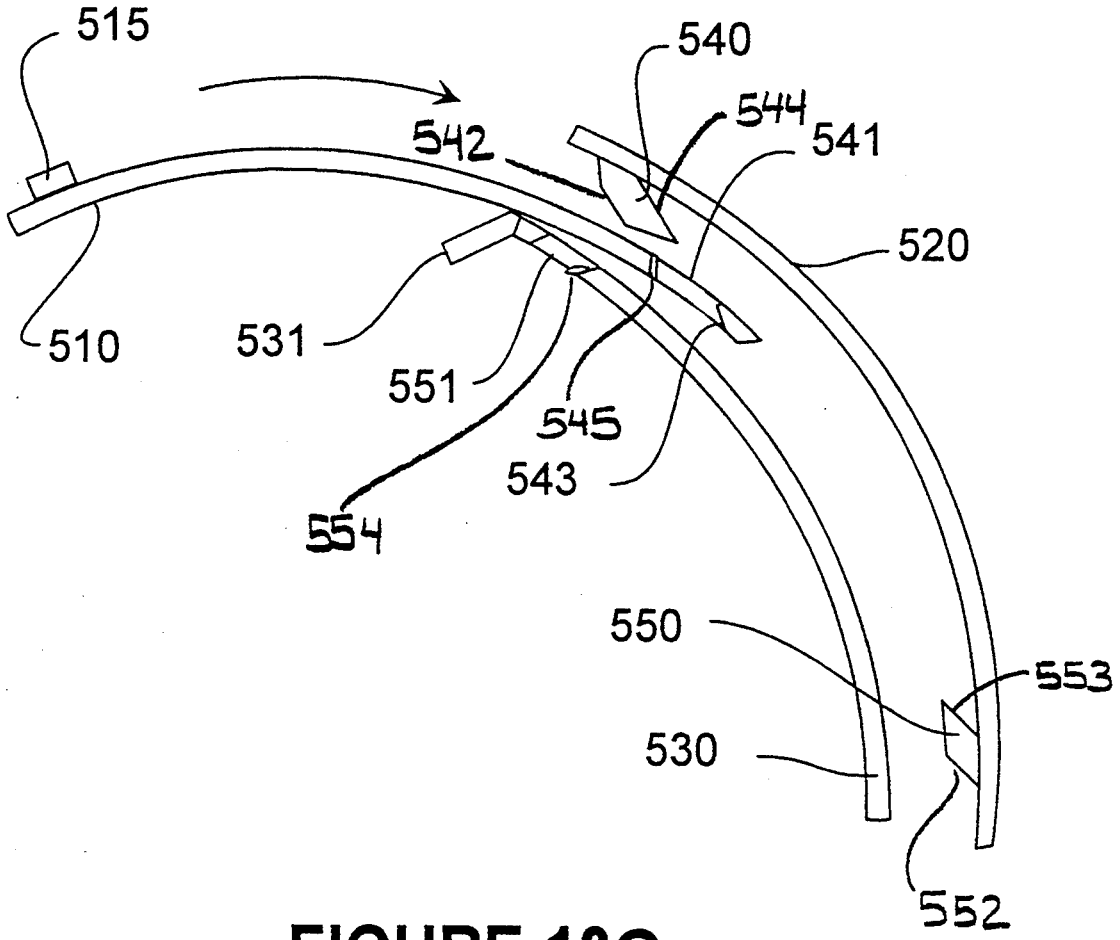
Figure 13D:
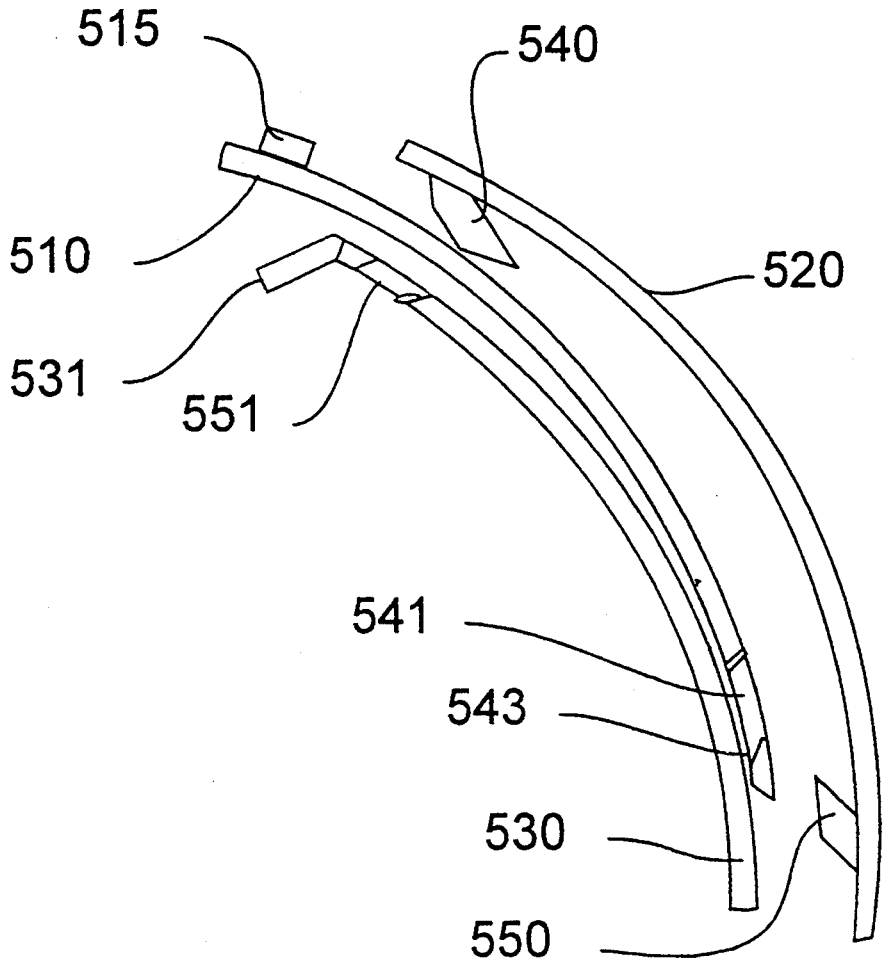

The shutter system pieces are of different widths so that when the shutter system is in its open position pieces will nest together at the back of the dome, exposing the zenith of the shutter opening. Preferably, the rear cover 530 is the narrowest of the shutter sections, the front shutter 510 wider than the rear cover 530, and the top shutter 520 the widest of the three pieces. In their nested position at the rear of the dome structure, as depicted in FIG. 13*d*, the rear cover 530 is under the front shutter 510 which is under the top shutter 520. Each shutter has downward side flanges 502, not shown in FIGS. 13*a–d*, that cover and protect the shutter beneath it.

In operation, to close the shutter system from the open or nested shutter position, the user pulls on a handle 515 to move the front shutter 510 toward the front of the shutter opening. The underside of the front shutter 510 slides on the top of the shutter opening edge 460 of the dome 400. As the front shutter 510 moves forward, a latch 540 on the top shutter 520 falls into a latch receiving hole 541 in the front shutter 510. Once the latch 540 is engaged with latch receiving hole 541, the diagonal edge 542 of latch 540 catches on the rear edge 543 of the latch receiving hole 541 in front shutter 510 so that the motion of the front shutter 510 is transferred to the top shutter 520 and the two pieces move in tandem.

The front shutter 510 and the top shutter 520 continue to move in tandem until the front shutter 510 is almost to its closed position. At this point, latch 550 located at the rear end of the top shutter 520 falls into its latch receiving hole 551 in the rear cover 530. The diagonal edge 552 of latch 550 catches on the forward edge 554 of the latch receiving hole 551, stopping the motion of the movable shutter pair in its closed position.

When closed as described, the three shutter components 510, 520 and 530 are connected solidly together. The front edge of the front shutter 510 may then be connected to the shutter opening edge 460 to lock all of the shutters into place so that the wind or an attempted forced entry cannot move the shutters.

To open the shutter system, either manual means or a motorized system may be used. In the case of manual means, the user lifts and pushes up on the handle 515 attached to the front shutter 510. As front shutter 510 moves up a very small distance, the edge 545 of the front latch receiving hole 541 encounters the flat edge 544 of the front latch 540, causing the front shutter 510 to push the top shutter 520 toward the rear of the dome 400. At the same time, the rear latch 550 on the top shutter 520 slips out of its receiving hole 551 because its diagonal edge 553 can slip out of and away from the diagonal edge 554 of the rear latch receiving hole 551.

Thus, the front shutter 510 and the top shutter 520 move together toward the rear of the dome 400 following the path of the shutter opening edges 460. As the front and top shutters 510 and 520 continue to move, the front latch 540 of the top shutter 520 encounters the horizontal lip 531 of the rear cover. The horizontal lip 531 has a slope which pushes the front latch 540 out of its latch receiving hole 541 as the front shutter 510 moves across it. Thus the top shutter 520 is disengaged from the front shutter 510. The front shutter 510 continues moving to the rear of the dome 400 to its nesting place between the rear cover 530 and the top shutter 520.

For a motorized system, the foregoing operation is performed by means of a motor, wire cables, and appropriate gearing means so that the shutter sections are moved in the manner described above.

The latching system described above and depicted in the drawings shows the use of latches on the horizontal surface of the shutter sections. In an alternative embodiment, the latches may be mounted on the side flanges of the shutter sections.

As will readily be appreciated by those skilled in the art, the component parts of the prefabricated observatory dome structure of the present invention are preferably prefabricated at the factory to allow simple and relatively inexpensive shipment of the component parts to the desired assembly site. The component parts are adapted to be easily fastened together to permit rapid assembly of the observatory dome structure by unskilled labor using standard tools and equipment.

In a preferred embodiment, the sections and parts making up the observatory dome structure 100 are fastened together with bolts. Stainless steel bolts may be used to minimize corrosion. In one embodiment, the bolt holes are drilled before pieces are assembled and fastened together. The sections and parts may also be fastened together using adhesive means or any other suitable fastening means.

The prefabricated observatory dome structure 100 must rest on a secure foundation system 600 in the form of a ground foundation, or framing support if it is to be installed on a roof, a deck or other structure. The major purpose of the foundation is not to support the weight of the observatory dome structure 100, but rather to provide a stable support under all environmental conditions. The foundation 600 must support the observatory dome structure 100 so that the base portion 200 and the dome 400 do not twist as the ground freezes or thaws or becomes dry or wet as this could cause the dome 400 to become hard to rotate. Additionally, the foundation 600 must be able to hold the observatory dome structure 100 down in the case of severe wind. Depending on the area of the country, hurricane or other winds up to or surpassing 80 mph can occur, so building codes require that buildings and their foundations resist such winds. Further, in most cases, the foundation system 600 must provide some means of leveling the observatory dome structure 100. Suitable means include the use of shims under the wall ring 220 or base ring 210, or the use of studs in the foundation 600 with adjusting nuts. The foundation 600 should be built to be as level as possible, so that height adjustments to level the base portion 200 are minimal and easy to do.

After the foundation is prepared, the bottom-most wall ring 220 is then attached to the foundation 600. The lower flange 222 of the bottom-most wall ring 220 may be attached by any suitable means such as lag bolts and anchors or foundation bolts already cast into the foundation 600. After the bottom-most wall ring 220 is installed, it should be leveled by adjusting the bolts or by using shims or the like. Then the remaining wall rings 220 are attached by any suitable means. Normally, the leveling does not need to be repeated with successive wall rings 220. After the base 200 is in place, leveled and fitted with rollers 430, the dome support ring 300 is put in place. The dome hemispherical halves 410 and 420 are set on this ring and fastened to the dome support ring 300 with any suitable means. Then the rear cover 530 is fastened to the hemispherical halves 410 and 420. Finally, the front and top shutters 520 and 510 are put in place at the front and top of the dome 100.

The description of the preferred embodiment is not intended to limit the protection afforded this invention. Changes and modifications in the described preferred embodiment can be implemented without departing from the intended scope of the invention. The appended claims are therefore intended to cover and embrace any such modifications, within the limits only of the true spirit and scope of the invention.

What is claimed is:

1. A prefabricated observatory dome structure comprising a modular wall structure, said modular wall structure comprising a circular base ring having an inner curve and an outer curve, with an upper flange portion and a lower flange portion located on the inner curve forming a generally C-shaped cross-section;

a rotatable dome structure rotatably connected to said modular wall structure, wherein said rotatable dome structure comprises two hemispherical halves containing a shutter opening located between said hemispherical halves; and a retractable shutter system connected to said dome structure, said shutter system comprising a moveable front shutter, a moveable top shutter and a stationary rear cover, wherein when said shutter system is in a closed position it covers said shutter opening and when said shutter system is in an open position, said front shutter and said top shutter nest with said rear cover.

2. The prefabricated observatory dome structure of claim 1 wherein said base ring comprises a plurality of base ring sections connected to form said base ring.

3. The prefabricated observatory dome structure of claim 1 wherein said modular wall structure further comprises a circular wall ring having an inner curve and an outer curve, with upper flange portion and a lower flange portion located on the inner curve, wherein said the upper flange portion of said wall ring is connected to said lower flange portion of said base ring.

4. The prefabricated observatory dome structure of claim 3 wherein said modular wall structure further comprises at least one additional wall ring wherein the wall rings are in a stacked position with the upper flange portion of the lower wall ring connected to the lower flange portion of the adjoining wall ring.

5. The prefabricated observatory dome structure of claim 3 wherein said modular wall portion further comprises a foundation skirt attached to the lower flange portion of said wall ring.

6. The prefabricated observatory dome structure of claim 1 wherein said rotatable dome structure further comprises a dome support ring having an upper flange portion forming a generally right angle with a skirt portion, wherein said hemispherical halves are fastened to the upper flange portion of the dome support ring in a spaced relationship to form a generally rectangular shaped shutter opening.

7. The prefabricated observatory dome structure of claim 6 further comprising means for retaining the dome on said wall portion.

8. The prefabricated observatory dome structure of claim 7 wherein said dome retaining means comprises a reverse flange portion on the upper flange portion of the base ring, wherein said reverse flange portion encloses the upper flange portion of the dome support ring and the portion of the hemispherical halves fastened to said dome support ring in a nesting relationship.

9. The prefabricated observatory dome structure of claim 6 further comprising a semi-door in said modular wall structure and a closeable opening in said dome support ring at the shutter opening, wherein said semi-door is aligned with said dome support ring opening to provide a doorway for access to the interior of the observatory dome structure.

10. The prefabricated observatory dome structure of claim 9, wherein the semi-door is constructed from a cut-out section of the modular wall structure.

11. The prefabricated observatory dome structure of claim 9, wherein the semi-door is a separately molded structure.

12. A modular wall system comprising a plurality of wall panels adapted to be connected together from a wall wherein said wall panels comprise generally C-shaped wall panels each having an inner curve and outer curve, with an upper flange portion and a lower flange portion located on the inner curve, wherein said upper flange portion and said lower flange portion are adapted to maintain the curvature of the wall panels and each wall panel having a C-shaped first male end that is stepped inward and a second female end wherein the first male end of one wall panel is adapted to be connected to the second female end of another wall panel.

13. The modular wall system of claim 12 further comprising a plurality of wall layers, wherein said wall layers are stacked so that the upper flange of one wall layer abuts the lower flange of the adjoining wall layer.

14. The modular wall system of claim 13 wherein each wall layer lower flange further comprises a reverse flange portion that connects with the upper flange portion of the adjoining wall layer in a nesting relationship to form a weather-tight seal.

15. The modular wall system of claim 12 wherein said wall layer is in the form of a circle.

16. A shutter system for a substantially semispherical observatory dome structure having a generally rectangular opening with parallel slot edges, said shutter system comprising:

a rear cover with a front edge, a rear edge, and two parallel side edges with flanges, wherein said rear cover is adapted to be connected in a stationary position to said observatory dome structure at said side edges and at said rear edge;

a moveable front shutter with a front edge, a rear edge, and two parallel side edges with flanges, wherein said front shutter is slidably engaged with said rear cover and said observatory dome structure by means of said flanges on said side edges, said flanges adapted to cooperate with the parallel slot edges of said observatory dome structure; and a moveable top shutter with a front edge, a rear edge, and two parallel side edges with flanges, wherein said top shutter is slidably engaged with said front shutter and said observatory dome structure by means of said flanges on said side edges; said flanges adapted to cooperate with the parallel slot edges of said observatory dome structure;

wherein when the shutter system is in its closed position, the front edge of the top shutter overlaps the rear edge of the front shutter and the rear edge of the top shutter overlaps the front edge of the rear cover, and when the shutter system is in its open position, the top and front shutters are in a nested position with the rear cover.

17. The shutter system of claim 16 further comprising a latching system, said latching system comprising:

a first latch receiving aperture located at the rear edge of the front shutter;

a first latch located at the front edge of the top shutter and releasably engagable with said first latch receiving aperture;

a second latch receiving aperture located at the front edge of the rear cover; and a second latch located at the rear edge of the top shutter and releasably engagable with said second latch receiving aperture;

wherein when said shutter system is in its closed position, said first latch is engaged with said first latch receiving aperture and said second latch is engaged with said second latch receiving aperture, and when said shutter system is in its open position, said first and second latches are disengaged from their respective latch receiving apertures.

18. The shutter system of claim 17 wherein the latching system further comprises:

a first latch comprising:

a front surface comprising:

a flat face portion for moving the top shutter section when opening the shutter system, and a diagonal face portion for disengaging the top shutter section during the opening of the shutter system; and a rear surface with a diagonal face for engaging the front shutter section during the closing of the shutter system; and a second latch comprising:

a front surface with a diagonal face for engaging the rear cover during the closing of the shutter system; and a rear surface with a diagonal face for disengaging the rear cover during the opening of the shutter system and for engaging the rear cover during the closing of the shutter system; and a lip portion on the front edge of the rear cover section that cooperates with the first latch during the opening of the shutter system to disengage the first latch from the front shutter section.

19. The shutter system of claim 18 wherein the shutter is manually moveable.

20. The shutter system of claim 18 wherein the shutter is moved by motorized means.

21. A rotatable dome for an observatory dome structure, said rotatable dome comprising:

a circular dome support ring having a generally L-shaped cross-section, wherein one leg of said dome support ring comprises a horizontal flange portion and the other leg of said dome support ring comprises a vertical dome skirt portion;

a first hemispherical half having a first curved edge and a second curved edge, with a first equatorial flange portion located along said first curved edge, wherein said first hemispherical half is attached to said dome support ring flange portion by means of said first equatorial flange portion;

a second hemispherical half having a first curved edge and a second curved edge, with a second equatorial flange portion located along said first curved edge, wherein said second hemispherical half is attached to said dome support ring flange portion by means of said second equatorial flange portion in a spaced relationship to said first hemispherical half forming an opening with parallel sides;

a shutter system for removably covering said opening; and rotation means for rotating said dome support ring, wherein said skirt portion of said dome support ring is adapted to maintain the dome in a centered position during rotation of the dome.

22. The dome structure of claim 21 wherein said dome support ring comprises a plurality of arcuate dome support ring sections assembled to form said dome support ring.

23. The dome structure of claim 21 wherein each hemispherical half comprises a plurality of sections.

24. The dome structure of claim 23 wherein each hemispherical half comprises two hemispherical quadrant sections.

25. A kit for a prefabricated observatory dome structure comprising:

a modular wall structure, said modular wall structure comprising a circular base ring having an inner curve and an outer curve, with an upper flange portion and a lower flange portion located on the inner curve forming a generally C-shaped cross-section;

a rotatable dome structure rotatably connectable to said modular wall structure, wherein said rotatable dome structure comprises a dome support ring and two hemispherical halves fastened to said dome support ring in a spaced relationship to form a generally rectangular shaped shutter opening; and a retractable shutter system connectable to said dome structure, said shutter system comprising a moveable front shutter, a moveable top shutter and a stationary rear cover that are slidingly engaged so that when said shutter system is in a closed position it covers said shutter opening and when said shutter system is in an open position, said front shutter and said top shutter nest with said rear cover.

* * * * *